US008502482B1

(12) United States Patent
Yeh

(10) Patent No.: US 8,502,482 B1
(45) Date of Patent: Aug. 6, 2013

(54) COMPACT INDUCTION LAMP

(76) Inventor: John Yeh, Riverside, CA (US)

( * ) Notice: Subject to any disclaimer, the term of this patent is extended or adjusted under 35 U.S.C. 154(b) by 125 days.

(21) Appl. No.: 13/312,754

(22) Filed: Dec. 6, 2011

(51) Int. Cl.
*H01J 11/00* (2012.01)
*H01J 1/50* (2006.01)

(52) U.S. Cl.
USPC ..... 315/344; 315/248; 313/161

(58) Field of Classification Search
USPC ..... 315/344, 267, 248, 153; 313/153–155, 313/160–162
See application file for complete search history.

(56) References Cited

U.S. PATENT DOCUMENTS 4,622,495 A 11/1986 Smeelen
4,675,577 A * 6/1987 Hanlet ..... 315/248
4,797,595 A 1/1989 De Jong
5,412,288 A 5/1995 Borowiec et al.
5,434,482 A 7/1995 Borowiec et al.
5,598,069 A 1/1997 Van Os et al.
5,629,584 A 5/1997 Borowiec et al.
5,773,926 A 6/1998 Maya et al.
5,789,855 A 8/1998 Forsdyke et al.
5,834,905 A 11/1998 Godyak et al.
6,175,197 B1 1/2001 Kling
6,528,953 B1 3/2003 Pearson et al.
6,597,105 B1 7/2003 Oga et al.
6,650,041 B1 11/2003 Speer et al.
6,653,775 B1 * 11/2003 Speer et al. ..... 313/490
6,768,248 B2 * 7/2004 Chandler et al. ..... 313/46
6,784,609 B2 8/2004 Speer et al.
6,891,323 B2 5/2005 Lima et al.
7,119,486 B2 10/2006 Godyak et al.
7,990,041 B2 8/2011 Carter et al.

* cited by examiner

*Primary Examiner* — James H Cho
(74) *Attorney, Agent, or Firm* — Eric Gani

(57) ABSTRACT

The present invention discloses an improved compact induction lamp, which includes a lamp bulb coated with a phosphor layer on its inner wall and contains inert gas and mercury vapor. The lamp bulb is connected to a housing and mounted to a lamp base. The housing may include a control circuit. A magnetic ring located within a ring cover surrounded the lamp bulb and enclosed one cross section of the lamp bulb. A wire coil wrapped around the magnetic ring is connected with the control circuit and to the lamp base, which generates an electromagnetic field to lighten the lamp. A double wall exhaust tube containing mercury amalgam is disposed of in the housing at the lamp base to provide mercury vapor to the inner space of the lamp bulb. The double wall exhaust tube provides a mean to prevent the amalgam from penetrating into the lamp bulb and allows the lamp to be mounted in any direction the lamp may be operated.

18 Claims, 4 Drawing Sheets

COMPACT INDUCTION LAMP

TECHNICAL FIELD

The present invention relates generally to an induction lamp and more particularly to a compact induction lamp.

BACKGROUND OF THE INVENTION

Fluorescent lamp which have a higher degree of efficiency and a longer operating life compared with an incandescent lamp, have been widely used as an alternative light source to replace incandescent lamp. Moreover, recently, in addition to conventionally used fluorescent lamps, electrodeless fluorescent lamps have been put to practical use and been under development. These electrodeless fluorescent lamps are also commonly known as electromagnetic induction lamps or simply induction lamps. Since induction lamps have no electrodes, they have an even higher efficiencies and longer operating life than that of conventional fluorescent lamps with electrodes and have a potential for becoming more and more widespread in the future. The induction lamps that are being sold in the market today are primarily used for lighting at locations where replacing lamps requires a high cost, such as landscape lighting, street lighting, bridge lighting, public park lighting, lighting for factories with high ceilings, etc.

In recent years, compact induction lamps (CIL) have been developed in the art that can be plugged into incandescent lamp sockets and used as if they were incandescent lamps, while retaining the advantageous characteristics of their larger counterparts such as the high efficiencies and long lifetimes. In addition, most induction lamps use solid mercury or mercury amalgam. In this form, the mercury is compounded with other metals, similar to the amalgam once widely used in dental fillings. It will not release toxic mercury vapor when exposed to room temperature and poses no threat of contamination. The use of amalgam, aside from eliminating the risk of mercury contamination is also used to regulate the mercury vapor pressure inside the lamp vessel that will ultimately affect the lamp efficiency. The amalgam can also be easily recovered in the case of lamp breakage and simpler to recycle at end of lamp life.

Discussions have been made on widely spreading compact induction lamps (CIL) having such advantageous characteristics as an alternative light source replacing incandescent lamps or even fluorescent lamps. Specifically, compact induction lamps (CIL) including a lamp bulb and a control circuit or a ballast circuit integrated as one unit have been developed in the art and expected to become widespread, which can be plugged into incandescent lamp sockets so that they can be used to replace incandescent lamps at locations where incandescent lamps have conventionally been used, such as hotels, restaurants, and houses.

However, use of compact induction lamps (CIL) for this purpose has traditionally been limited due to its limited mounting direction. Traditionally, compact induction lamps (CIL) need to be installed with the base down. If operated in an inverted, base up orientation, there is a great concern that the heat generated by the lamp bulb will rise. As a result, the temperature within the housing rises, heating the bulb's base containing the circuit and shortening the bulb's life. Furthermore, prior art compact induction lamps (CIL) place the amalgam at the base of the bulb. When the lamp is operated in a base up orientation, in certain situation, there is a risk that the amalgam could penetrate into the bulb and damage the lamp. A look into the prior arts discovered multiple patents that are similar, such as the ones disclosed in U.S. Pat. No. 6,528,953, U.S. Pat. No. 6,891,323, U.S. Pat. No. 5,650,041, and U.S. Pat. No. 5,629,584. However, none of them possesses the novelty of the instant invention.

SUMMARY OF THE INVENTION

The present invention is directed to a compact induction lamp comprises of an induction lamp tube or lamp bulb sealed in a vacuum tight manner and contains a mixture of inert gas and mercury vapor. The lamp bulb is connected to a housing and mounted to a lamp base. The housing may include a control circuit or a ballast circuit. A wire is wrapped in a coil around a magnetic ring surrounded by a ring cover and enclosing one cross section of the lamp bulb. The wire coil is connected to the control circuit and to the lamp base such that when a power source is supplied to the base, the coil generates an electromagnetic field to lighten the lamp. A double wall exhaust tube containing a solid mercury amalgam is disposed of in the housing at the base of the lamp bulb.

The double wall exhaust tube comprises of a first inner tube with a first inner wall and a second outer tube with a second outer wall. The first inner tube enclosed a solid amalgam and optionally a metal wire and has one or more openings at the side of the first inner wall. The second outer tube enclosed the first inner tube and has one or more openings at one end that is in communication with the interior of the lamp bulb and has an opposite end that is fused and jointly sealed with the first inner tube. The exhaust tube may also be disposed of on the outside of the lamp bulb nearest to the housing and may include a variety of different shapes including but not limited to a straight tube, an L-shape, a U-shape, a V-shape, etc. The construction of the exhaust tube according to the present invention prevent the amalgam from escaping and penetrating into the lamp bulb while still allowing vapor to flow between the tube and the bulb. The compact induction lamp according to the present invention obviates the risk of the amalgam getting inside the lamp bulb where it can cause changes in the lumen output and reduce the performance of the lamp.

In view of the above disclosure, it is an object of the present invention to provide a compact induction lamp that can be installed in any position the lamp may be operated.

Another object of the invention is to provide a compact induction lamp that provides a mean to prevent the amalgam from getting inside the lamp bulb and potentially reduce the lamp life.

These and other objects of the invention will be made apparent to one of skill in the art upon a review of this specification, the associated drawings and the appended claims.

BEST MODES OF CARRYING OUT THE INVENTION

Figure 1:
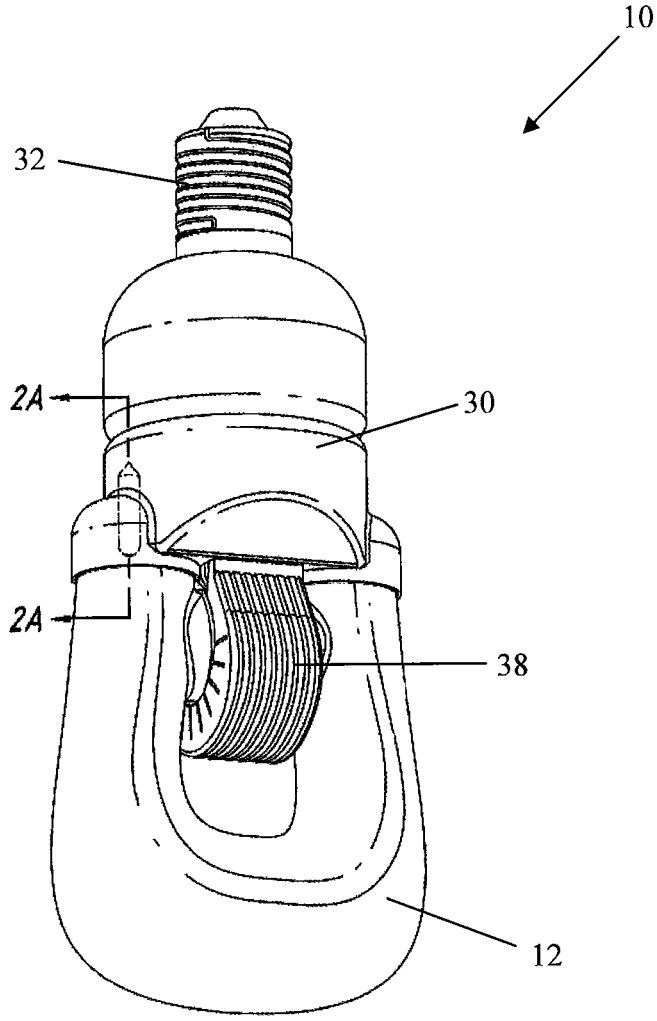
FIG. 1 is a perspective view of the preferred embodiment of the compact induction lamp according to the present invention
Figure 2:
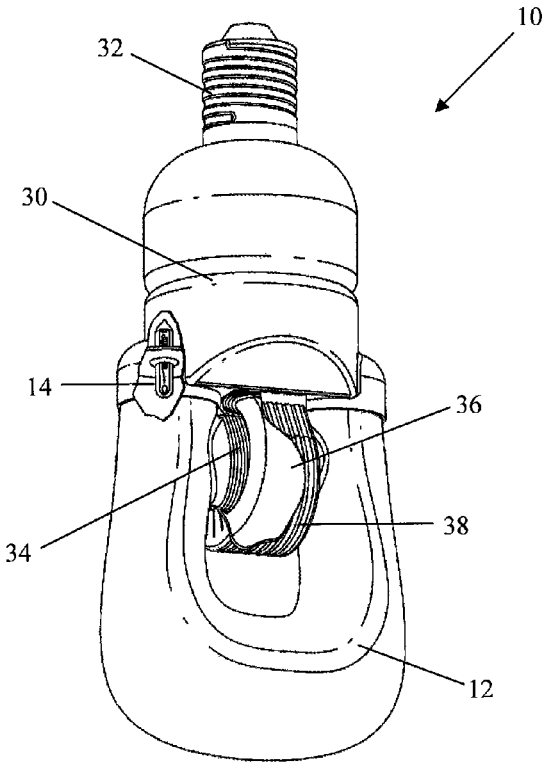
FIG. 2 is a partially exposed perspective view of the preferred embodiment of the compact induction lamp according to the present invention.
Figure 3:
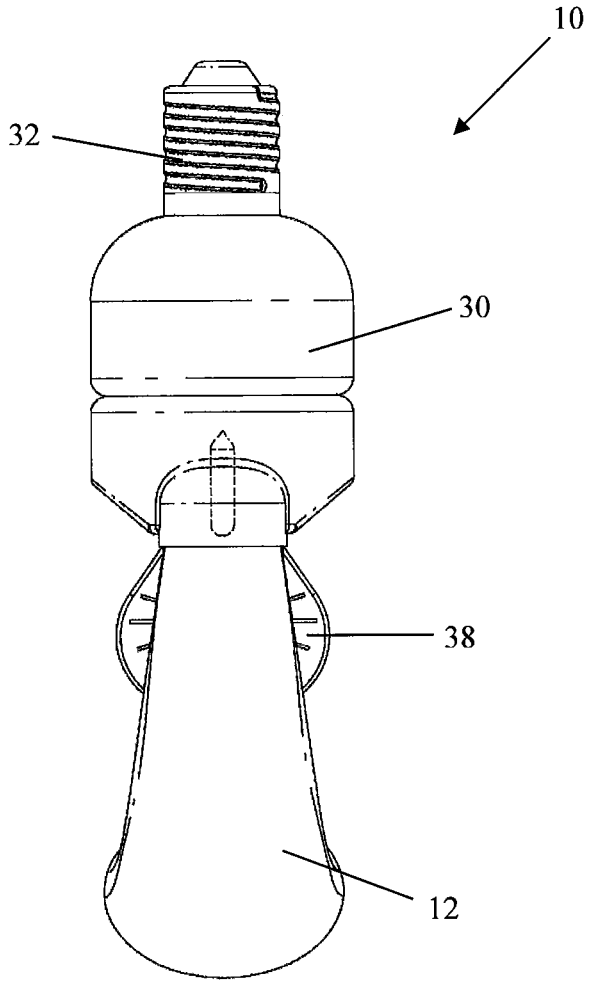
FIG. 3 is a side view of the preferred embodiment of the compact induction lamp according to the present invention.

The best mode of carrying out the invention is presented in terms of a preferred embodiment of a compact induction lamp (CIL) 10 as shown in FIG. 1-3. The preferred embodiment of the compact induction lamp (CIL) 10 according to the present invention comprises of a lamp tube or a lamp bulb 12 connected to a housing 30 and mounted to a lamp base 32. The lamp bulb 12 is coated with a phosphor layer on its inner surface, filled with a mixture of inert gas and mercury vapor and sealed in a vacuum tight manner. The housing 30 may include a control circuit or a ballast circuit (not shown). A ferrite or magnetic ring 36 located within a ring cover 38 surrounded the lamp bulb 12 and enclosed one cross section of the lamp bulb 12. A wire 34 wrapped in a coil around a cross section of the lamp bulb 12 and a portion of the magnetic ring 36 is connected to the control circuit and to the lamp base 32. An exhaust tube 14 containing solid mercury amalgam 20 is disposed of in the housing 30 and is in communication with the interior of the lamp bulb 12.

When a power source is supplied to the wire coil 34 via the lamp base 32, the coil 34 forms a high frequency alternating magnetic field in the vicinity of the coil 34. This electromagnetic field generates an induction field that travels through the bulb 12 and excites the mercury and inert gas inside the bulb 12 to produce a light emission in the ultraviolet range. Emitted light in the ultraviolet range is converted into a visible light range by the phosphor coating on the interior surface of the lamp bulb 12. The compact induction lamp 10 according to the present invention is preferably one that has a structure in which the bulb 12 and the ballast circuit are integrated (self-ballasted) but may also include one where the ballast is not integrated as one unit (remote ballast). The lamp base 32 may include a variety of base type such as a screw-in base, a E26 base, a E39 base, a bi-pin base or the like such that it can easily be used as a replacement for incandescent lamps or conventional fluorescent lamps.

Figure 2A:
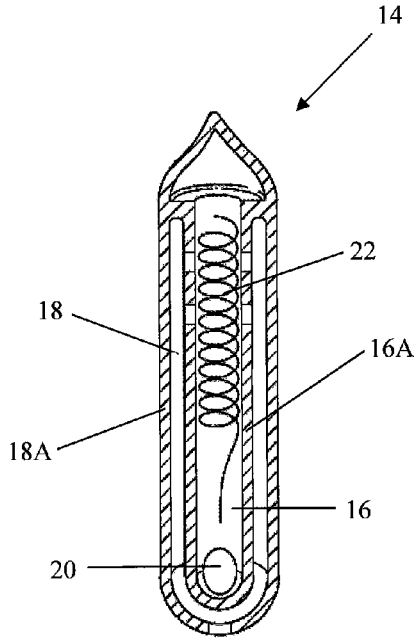
FIG. 2A is a sectional view of the exhaust tube of the compact induction lamp according to the preferred embodiment of the present invention.

The exhaust tube 14 comprises of a double wall construction herein after referred to as a double wall exhaust tube 14. The double wall exhaust tube 14 forms a double tube arrangements having a first inner tube 16 with a first inner wall 16A and a second outer tube 18 with a second outer wall 18A. The first inner tube 16 contains a solid mercury amalgam 20 and optionally a metal wire 22 and is sealed at both ends. The metal wire 22 is commonly placed inside the exhaust tube 14 to conduct heat and restrict movement of the amalgam 20. The first inner tube 16 has one or more openings at the periphery of the first inner wall 16A as shown in FIG. 2A. The opening has a size that is smaller than the size of the amalgam 20 to prevent the amalgam 20 from going out into the second outer tube 18 and potentially penetrating into the lamp bulb 12. The second outer tube 18 completely enclosed the first inner tube 16 and has one or more openings at one end that is in communication with the lamp bulb 12 and has another end that is in contact with one end of the first inner tube 16 where they fused and are jointly sealed.

The exhaust tube of prior art compact induction lamp is constructed of a single wall, has one closed end and one open end that is in communication with the bulb. When operated in the base up orientation, there is a possibility that the amalgam can penetrate into the lamp bulb through the open end. The present invention solves this problem by using a double wall exhaust tube 15. The exhaust tube 14 of the compact induction lamp 10 according to the present invention is located in the housing 30 at the foot or base of the lamp bulb 12 similar to the prior art compact induction lamp. The double wall construction of the exhaust tube 14 provides ample volume to contain the amalgam 20 and held it in a relatively fixed position while still permits the necessary mercury vapor to flow between the tube 14 and the bulb 12. The double wall construction will allow installation of the lamp 10 in any position in which the lamp 10 may be operated, including but not limited to base up, base down or base horizontal position. This is because the amalgam 20 in the present invention is enclosed within the first inner tube 16 that is completely sealed at both ends. Thus, providing no path for the amalgam 20 to exit no matter which orientation the lamp 10 may be operated The amalgam 20 utilized for the purpose of this invention can be any conventional amalgam that is known in the art of mercury vapor discharge lamp. An exemplary amalgam comprises pure indium or a combination of bismuth and indium. Another exemplary amalgam comprises a combination of lead, bismuth and tin. Still another exemplary amalgam may comprise zinc or a combination of zinc, indium and tin. The compact induction lamp 10 as disclosed in the present invention solves the prior art problem associated with the limited mounting direction and alleviate the risk of the amalgam 20 penetrating into the lamp bulb 12 which can potentially reduce the efficiency and the life of the lamp and void manufacturer's warranty.

Figure 4:
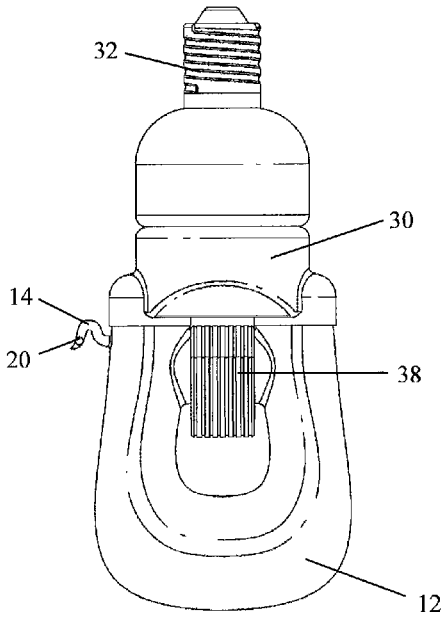
FIG. 4 is a front view of the compact induction lamp according to the second embodiment of the present invention.
Figure 5:
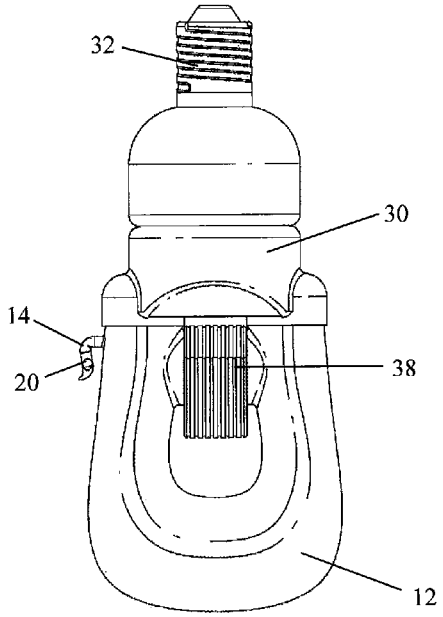
FIG. 5 is a front view showing an alternative structure of the exhaust tube according to the second embodiment of the compact induction lamp according to the present invention.

According to a second embodiment of the present invention, the compact induction lamp 10 has an exhaust tube 14 that protrudes from the side of the bulb 12 nearest to the housing 30 and in the vicinity of the ring 36. An exemplary embodiment of the exhaust tube 14 according to the second embodiment of the present invention is shown in FIG. 4 and FIG. 5. However, the exhaust tube 14 according to the second embodiment is not limited to such configuration or shape and may include a variety of different structures including but not limited to a straight tube, an L-shape, a U-shape, a V-shape, etc. The compact induction lamp 10 according to the second embodiment operates and functions in the same manner as the preferred embodiment and possesses the same benefits and advantages of the preferred embodiment with the only difference being the location of the exhaust tube 14.

Although the invention has been described in some detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A compact induction lamp comprising:

a) a lamp bulb sealed in a vacuum tight manner, b) a housing to hold the lamp in place, c) a lamp base for connection to a power source, d) a wire coil wrapped around a magnetic ring and enclosed in a ring cover surrounding one cross section of said lamp bulb, e) an exhaust tube that is in communication with the interior of said lamp bulb and contains a solid mercury amalgam.

2. The compact induction lamp as specified in claim 1 wherein said lamp can be operated in any orientation such as base up, base down or base horizontal position.

3. The compact induction lamp as specified in claim 1 wherein said lamp bulb contains a mixture of inert gas and mercury vapor.

4. The compact induction lamp as specified in claim 1 wherein said lamp bulb is coated with a phosphor layer on its inner wall for converting ultraviolet radiation into visible light.

5. The compact induction lamp as specified in claim 1 wherein said housing may include a control circuit or a ballast circuit.

6. The compact induction lamp as specified in claim 1 wherein said lamp base can include a variety of base type including a screw-in base, a E26 base, a E39 base, a bi-pin base or the like.

7. The compact induction lamp as specified in claim 1 wherein said wire coil is connected to the control circuit and to the lamp base such that when a power is supplied to the base, the coil generates an electromagnetic field that excites the gas and mercury vapor inside the bulb to emit light.

8. The compact induction lamp as specified in claim 1 wherein said exhaust tube comprises of a double wall construction having a first inner tube with a first inner wall and a second outer tube with a second outer wall.

9. The exhaust tube as specified in claim 8 wherein said first inner tube is sealed at both ends and contains a solid amalgam and optionally a metal wire.

10. The exhaust tube as specified in claim 9 wherein said first inner tube have one or more openings at the periphery of said first inner wall.

11. The exhaust tube as specified in claim 8 wherein said second outer tube enclosed the first inner tube and has one or more openings at one end that is in communication with the interior of the lamp bulb and has another end that is in contact with said first inner tube where they fused and jointly sealed.

12. The compact induction lamp as specified in claim 1 wherein said exhaust tube provides a mean to prevent the amalgam from escaping and penetrating into the lamp bulb while still allowing vapor to flow between said tube and said bulb.

13. The compact induction lamp as specified in claim 1 wherein said exhaust tube is disposed of in the housing at the base of the lamp bulb.

14. The compact induction lamp as specified in claim 1 wherein said exhaust tube is disposed of on the outside of the lamp bulb near the housing and in the vicinity of the ring, wherein said tube can include a variety of different shapes such as a straight tube, an L-shape, a U-shape, and a V-shape.

15. An improved compact induction lamp that can be operated in any orientation such as base up, base down or base horizontal position, said lamp comprising:

a) a lamp bulb sealed in a vacuum tight manner and contain a mixture of inert gas and mercury vapor, b) a housing to hold the lamp in place and may include a control circuit or a ballast circuit, c) a lamp base for connection to a power source and may include a screw-in base, a E26 base, a E39 base, a bi-pin base or the like, d) a wire coil wrapped around a ring located within a ring cover enclosing one cross section of said lamp bulb, wherein said coil is connected with the control circuit and the lamp base, which generates an electromagnetic field to lighten the lamp when a power source is supplied to the base, e) an exhaust tube containing a solid mercury amalgam disposed of in the housing at the base of said lamp bulb wherein said exhaust tube comprises of a double wall construction having a first inner tube with a first inner wall and a second outer tube with a second outer wall.

16. The exhaust tube as specified in claim 15 wherein said first inner tube is sealed at both ends and contains a solid amalgam and optionally a metal wire.

17. The exhaust tube as specified in claim 15 wherein said first inner tube have one or more openings at the periphery of said first inner wall, wherein said openings have a size that is smaller than the size of the amalgam to prevent the amalgam from exiting the tube while still allowing vapor to flow.

18. The exhaust tube as specified in claim 15 wherein said second outer tube enclosed the first inner tube and has one or more openings at one end that is in communication with the interior of the lamp bulb and has another end that is in contact with said first inner tube where they fused and jointly sealed.

* * * * *